US011361738B2

(12) United States Patent
Baasch et al.

(10) Patent No.: US 11,361,738 B2
(45) Date of Patent: Jun. 14, 2022

(54) METHOD AND APPARATUS FOR ARTIFICIAL PLAYING-IN OF A MUSICAL INSTRUMENT STRING AND METHOD AND APPARATUS FOR PRODUCING A MUSICAL INSTRUMENT STRING

(71) Applicant: Larsen Strings A/S, Soenderborg (DK)

(72) Inventors: Kurt Baasch, Sønderborg (DK); Thomas Zwieg, Aabenraa (DK); Kristian Bach Sigvardt, København S (DK)

(73) Assignee: Larsen Strings A/S, Sonderborg (DK)

( * ) Notice: Subject to any disclaimer, the term of this patent is extended or adjusted under 35 U.S.C. 154(b) by 0 days.

(21) Appl. No.: 17/286,436

(22) PCT Filed: Oct. 17, 2018

(86) PCT No.: PCT/EP2018/078379
§ 371 (c)(1),
(2) Date: Apr. 16, 2021

(87) PCT Pub. No.: WO2020/078544
PCT Pub. Date: Apr. 23, 2020

(65) Prior Publication Data
US 2021/0390929 A1 Dec. 16, 2021

(51) Int. Cl.
*G10D 3/10* (2006.01)
*G10D 3/22* (2020.01)
*B21F 45/00* (2006.01)

(52) U.S. Cl.
CPC ..... *G10D 3/10* (2013.01); *B21F 45/00* (2013.01); *G10D 3/22* (2020.02)

(58) Field of Classification Search
CPC ... G10D 3/10; G10D 3/22; G10D 3/00; B21F 45/00
See application file for complete search history.

(56) References Cited

U.S. PATENT DOCUMENTS

| | | | | |
|---|---|---|---|---|
| 4,300,343 | A | 11/1981 | Nakamura et al. | |
| 2002/0035912 | A1 | 3/2002 | Barney | |
| 2017/0061939 | A1 * | 3/2017 | Hartley | C09D 183/04 |

* cited by examiner

*Primary Examiner* — Kimberly R Lockett
(74) *Attorney, Agent, or Firm* — Jonathan M. D'Silva; MMI Intellectual Property

(57) ABSTRACT

Method for artificial playing-in of a musical instrument string comprising one or more layers of wire(s) and/or band(s) wound around a core, in which the method comprises use of a flexing process on the musical instrument string during the production or after the winding of the last layer on the musical instrument string, but preferably before grinding of the surface of the musical instrument string, apparatus for artificial playing in a musical instrument string comprising one or more layers of wire(s) and/or band(s) wound around a core, in which said apparatus comprises a string tensioning device for clamping a musical instrument string between two points with a predefined fixed or variable pull force in its longitudinal direction to keep it taut, and a flexing device used during production of a musical instrument string.

21 Claims, 24 Drawing Sheets

Figure 1:
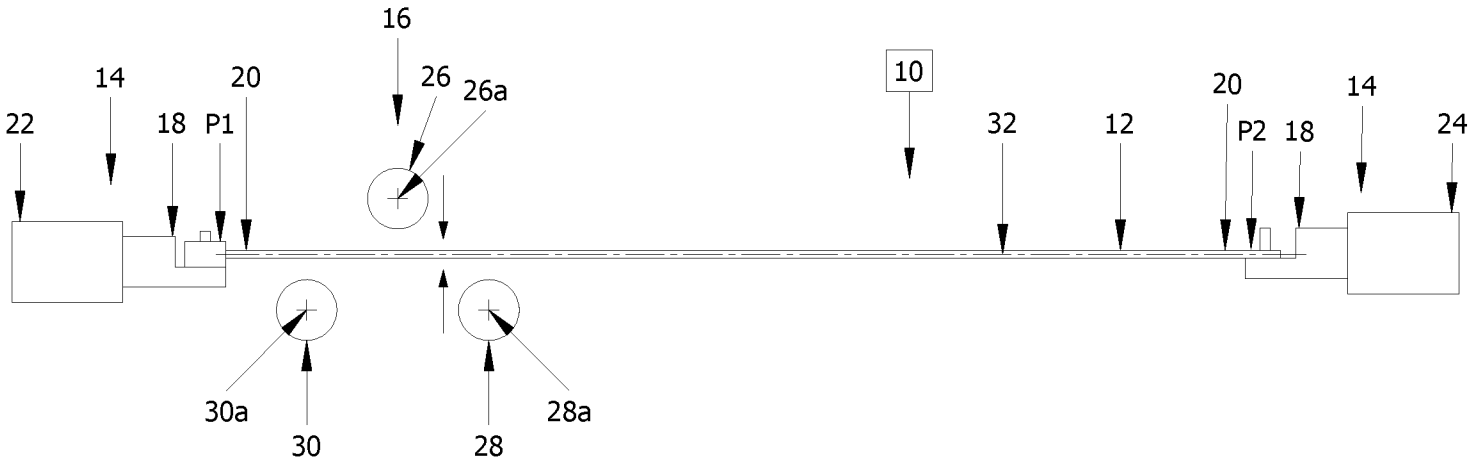

METHOD AND APPARATUS FOR ARTIFICIAL PLAYING-IN OF A MUSICAL INSTRUMENT STRING AND METHOD AND APPARATUS FOR PRODUCING A MUSICAL INSTRUMENT STRING

The present invention relates to a method and an apparatus for artificial playing-in a musical instrument string, and a method and an apparatus for producing a musical instrument string.

Normally a musical instrument string comprising one or more layers of plastic or metal wires and/or bands wound around a core with single or multi thread(s) is played-in ("playing-in" is a commissioning process, well known by musicians playing musical string instruments) over some time from the fixing and tuning on the instrument and subsequent use of the musical instrument string during a period of time, which causes the wire(s) and/or band(s) wound around the core and/or the different layers of the musical instrument string to be seated in a stable condition, where the wanted musical quality, string response and sound is achieved. This is time consuming.

Accordingly, it is the aim of the present invention to provide a method and an apparatus for accelerating the process towards the stable condition and the wanted stable sound as described above.

According to a first aspect, this aim is achieved by a method for artificial playing in a musical instrument string comprising one or more layers of wires and/or bands wound around a core, in which the method comprises use of a flexing process on the musical instrument string already during the production as an integrated part of the production or winding process or after winding the last layer on the musical instrument string, but preferably before grinding of the surface of the musical instrument string.

According to a further aspect this aim is achieved by an apparatus for artificial playing in a musical instrument string comprising one or more layers of wires and/or bands wound around a core, in particular an apparatus for carrying out a method according to any one of the claims 1 to 14, said apparatus comprising a string tensioning device for clamping a musical instrument string between two points with a predefined fixed or variable pull force in the longitudinal direction of the string to keep it taut, and a flexing device.

According to a third aspect this aim is achieved by a method for producing a musical instrument string comprising one or more layers of wires and/or bands wound around a core, the method comprising:

placing a core along a path, rotating the core around its central axis and helically winding one or more layers of wires and/or bands on top of it, and during production or winding flexing the product after each winding of said one or more layers of wires and/or bands.

According to a fourth aspect this aim is achieved by an apparatus for producing a musical instrument string comprising one or more layers of wires and/or bands wound around a core, in particular an apparatus for carrying out the method according to the claims herein, the apparatus comprising:

means for clamping a core of a musical instrument string fixed and for helically winding one or more layers of wires and/or bands around the core as the core rotates, and a flexing device.

According to a special embodiment of the method for artificial playing in a musical instrument string, the flexing process is carried out on the whole length of the musical instrument string or in the playable area (string area between bridge and nut on an instrument) of the musical instrument string or just one or more small arbitrary area(s) of the string.

Furthermore, the flexing process may be carried out in a single pass (one pass is one movement along the string in one direction) or a multi pass (at least one movement forward and/or at least one movement backwards along the string) after winding of the last layer on the musical instrument string.

Alternatively, the flexing process may be used in a single pass or a multi pass during the production of the musical instrument string.

In particular, the flexing process may be used in a single pass or a multi pass during the production of a musical instrument string on each layer after winding of one or more layers of wire(s) and/or band(s) around the core.

The flexing process may also be used in a multi pass at the production of a musical instrument string, with short passes starting an arbitrary place on the string and then moving along the string in a short area from this place or alternatively broader and broader passes from the starting place on the string in a broader and broader area.

Conveniently, the flexing process is carried out while the musical instrument string is clamped between two fixed points P1 and P2, or with a predefined constant pull force (one point, P1 or P2, moves, if the string gets longer in the fixing process) or a variable pull force in the longitudinal direction of the musical instrument string to keep the string taut. The pull force may be between 20 N and 200 N, preferably between 30 N and 100 N.

Advantageously, the musical instrument string is continuously or discontinuously rotated around its longitudinal axes during flexing.

In particular, the musical instrument string may be rotated around its longitudinal axis after at least one pass of multiple passes or after multiple passes of flexing. The flexing apparatus can be opened or remain closed when rotating the string.

Alternatively, a flexing apparatus or device can be moved around the string (instead of the string rotating around its own axes).

According to a further special embodiment the flexing process comprises bending the musical instrument string both to one side and to the other side of a line representing the original position of the musical instrument string, when being clamped between said two points, by at least two flexing elements, placed laterally and longitudinally with respect to said line, and moving simultaneously at least said two flexing elements relative to said musical instrument string over at least an area of the length of the musical instrument string, preferably in a reciprocating way.

The relative movement of the flexing elements may be performed with a manually or automatically driven apparatus or with a handheld apparatus.

Conveniently, the musical instrument string is bent around part of a roller with a predefined force transversal to the musical instrument string.

According to a further special embodiment the at least two flexing elements are rollers, preferably having respective aligned annular grooves herein, preferably perpendicular to the axis of rotation of said rollers, and the rollers are arranged in such a way that they run on the surface of the musical instrument string during production or after spinning of the last layer. Preferably two to eight rollers are provided.

Preferably, the diameter(s) of the rollers is/are in a range of about 10 mm to about 50 mm, more preferably 10 mm to 25 mm.

Furthermore, at least two diameters of the rollers may be identical or different.

According to a special embodiment of the apparatus for artificial playing in a musical instrument string, said flexing device comprises at least two spaced apart flexing elements configured to be positioned in such a way that the musical instrument string is bent around part of a roller simultaneously to both one side and to the other side of a line representing the original position of the musical instrument string, when being clamped between said two points.

In particular, at least said two flexing elements may be rollers, preferably 2 to 4 rollers mounted for rotation on respective axes perpendicular to said line.

Advantageously, the axes are parallel to each other.

Conveniently, said axes are movable transversal to said line, representing the original position of the musical instrument string, when being clamped between said two points.

According to a further special embodiment the rollers are mounted on a carriage that is movable parallelly to said line.

Preferably, said carriage has at least two spaced apart flexing elements with rollers which are movable perpendicularly to said line.

According to further special embodiment, the string tensioning device is configured to continuously or discontinuously rotate the musical instrument string around its longitudinal axis.

According to a special embodiment of the method for producing a musical instrument string the flexing is carried out in a respective single pass or multi pass process.

In addition, the method for producing a musical instrument string may comprise a flexing process analogous to the flexing process of the method according to any one of the claims 1 to 16.

According to a special embodiment of the apparatus for producing a musical instrument string, said flexing device comprises at least two flexing elements spaced apart and configured to be positionable, so that the musical instrument string is bent around part of a roller simultaneously to both one side and the other side of a line representing the original position of the musical instrument string, when being clamped between said two points.

Preferably, at least said two flexing elements are rollers mounted for rotation on respective axes perpendicular to said line.

Furthermore, the axes may be parallel to each other.

Preferably the axes are positioned for example 6×60°, 4×90°, 3×120° or 2×180°, preferably 90° or 120° between each other and perpendicular to said line.

According to a special embodiment the rollers are positioned with a longitudinal distance A between the rollers center to center, where A can be between 10 to 100 mm, preferably between 20 to 60 mm.

Preferably the rollers are positioned with an overlap of the rollers perpendicular to the longitudinal direction of the musical instrument string is defined by the transversal distance B between the rollers center to center, as for example the rollers 26 versus 28 and 30, where B can be between 0 mm to 25 mm, preferably between 5 mm to 15 mm.

According to a special embodiment the rollers are positioned with a distance C between the opposite rollers on each side of the musical instrument string, as for example the rollers 26 and 28 or 26 and 30, where C can be between 0 mm to 80 mm, preferably between 0.5 mm to 20 mm.

Conveniently, said axes are movable transversal to said line.

Conveniently, the rollers are mounted on a carriage that is movable parallel to said line.

Preferably the two spaced apart flexing elements of the carriage are movable perpendicular to said line.

Further, the string tensioning device may be configured to continuously or discontinuously rotate the musical instrument string around its longitudinal axis.

Finally, preferably the string tensioning device is configured to rotate the musical instrument string around its longitudinal axis in positions for example 0°-90°-180°-270° between the flexing movements, preferably in steps of 90° at a time.

The present invention is based on the surprising knowledge that by using a so-called flexing process a stable condition with the wanted musical quality, response and sound, can be achieved. The flexing process is used for exercising and flexibly aligning the wire(s) and/or band(s) wound around musical instrument strings with one layer or with more layers wound upon each other. Use of the flexing process will accelerate achieving the wanted musical quality, response and sound.

Figure 3:
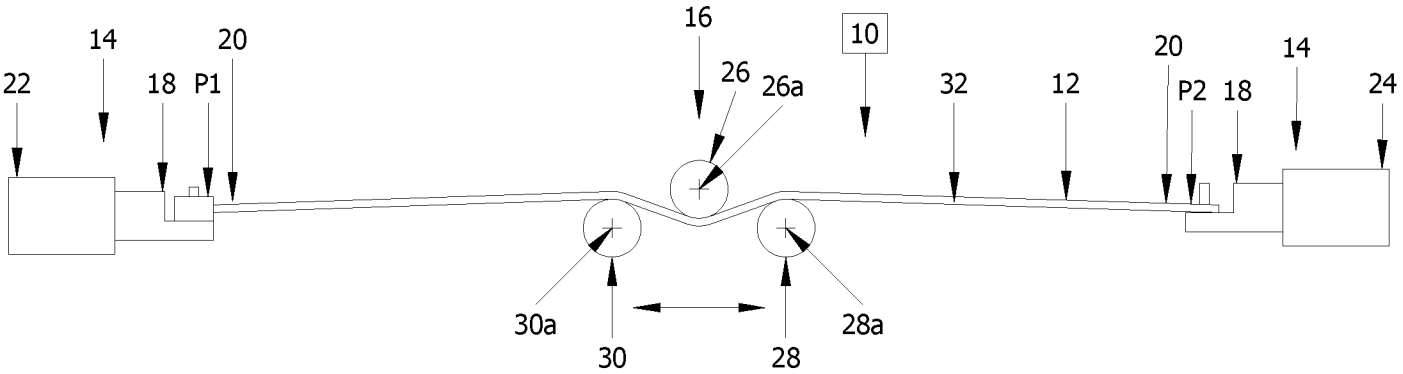
Figure 4:
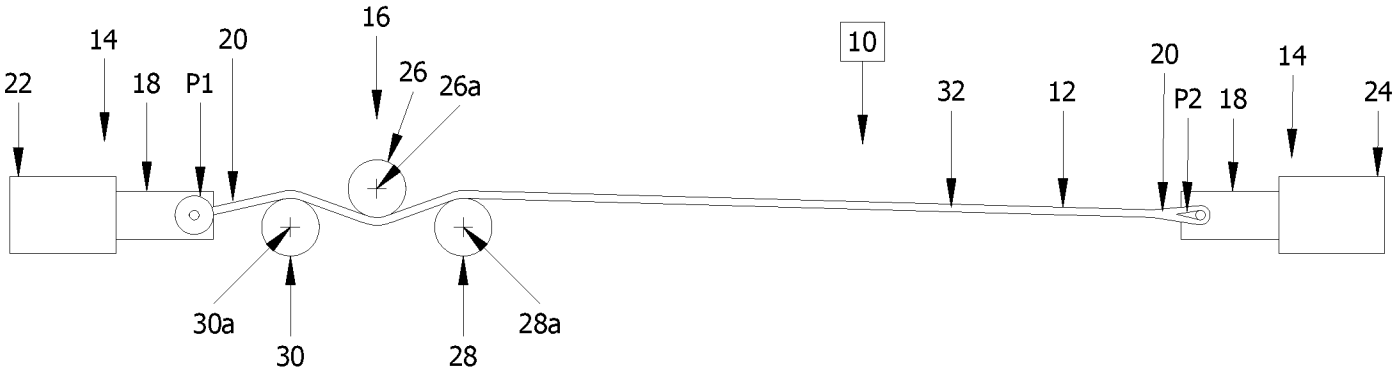
Figure 5A:
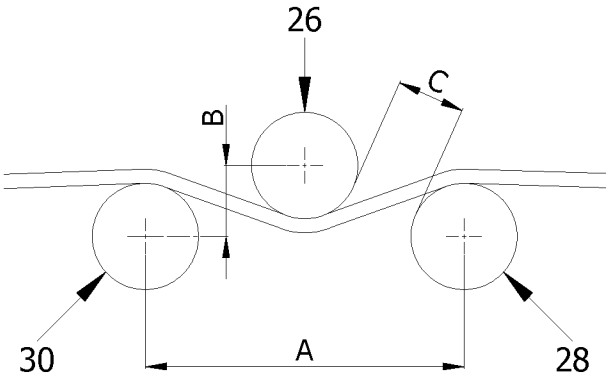
Figure 5B:
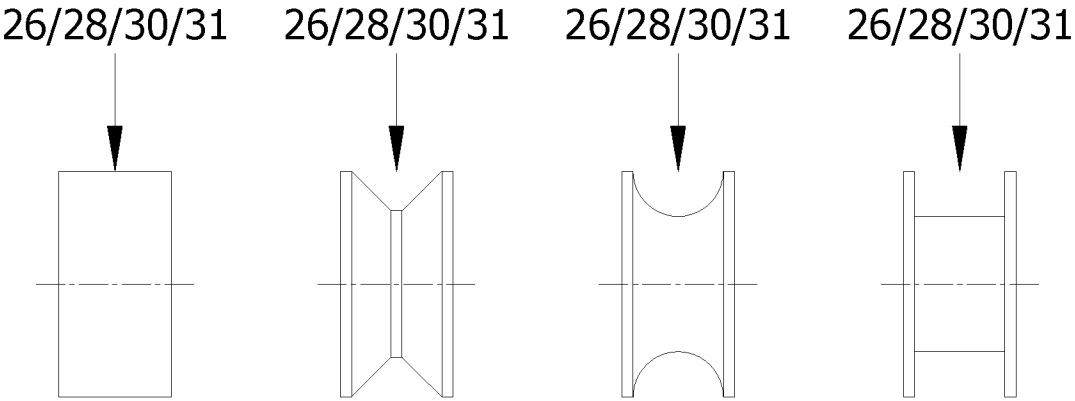
Figure 6:
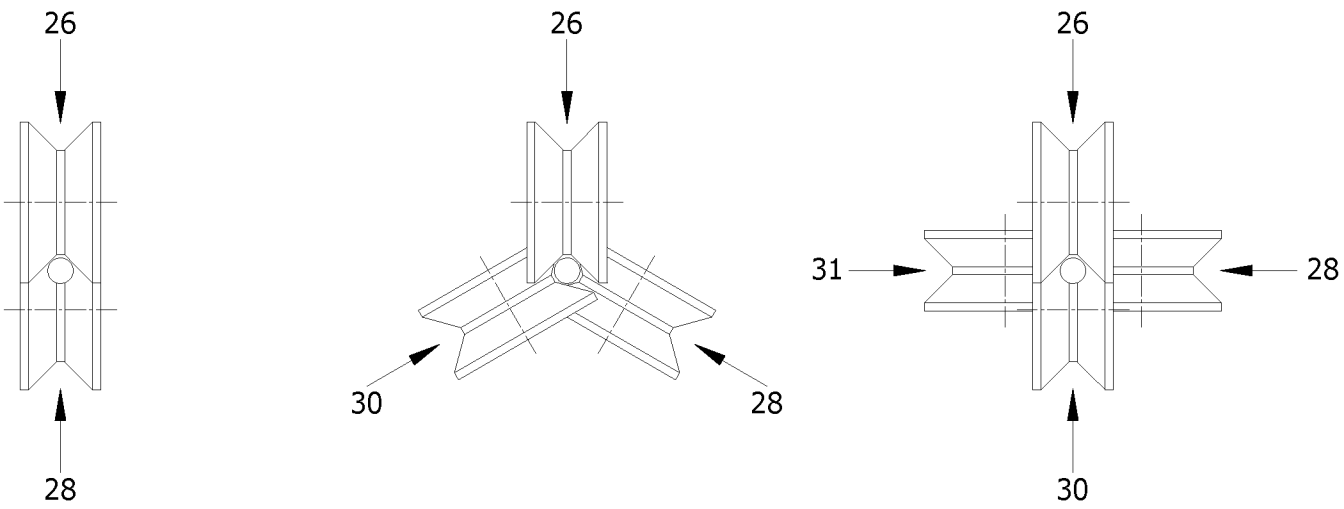

Further features and advantages of the present invention will be clear from the accompanying claims and the following description of special embodiments in combination with the schematic drawings, in which FIGS. 1 to 4 show an apparatus for artificial playing in a musical instrument string according to a special embodiment of the present invention and an apparatus for producing a musical instrument string according to a special embodiment of the invention, in part FIG. 5*a* shows example of rollers placement and distances between each other for a flexing process, FIG. 5*b* shows examples of rollers (wheels) for a flexing process, FIG. 6 shows examples of placing/orientating rollers for a flexing process, FIGS. 7*a*-7*k* show steps of a method for producing a musical instrument string according to a special embodiment of the present invention; and FIGS. 8*a*-8*f* show steps of a method for producing a musical instrument string according to a further special embodiment of the invention.

The apparatus 10 shown in FIGS. 1 to 4 could be an apparatus for artificial playing in a musical instrument string 12 comprising one or more wire(s) and/or band(s) wound around a core according to a special embodiment of the present invention or an apparatus for producing a musical instrument string 12 comprising one or more layers of wire(s) and/or band(s) wound around a core according to a special embodiment of the invention or part thereof. Said apparatus 10 comprises a string tensioning device 14 for clamping the musical instrument string 12 between two points P1 and P2 with a pull force fixed or variable in its longitudinal direction (in FIG. 1 corresponding to the horizontal direction) to keep it taut and a flexing device 16. The string tensioning device 14 comprises two fastening points e.q. hooks 18 at the point P1 and the point P2, respectively. The longitudinal ends 20 of the musical instrument string 12 are attached to said hooks 18. Said hooks 18 are connected to two motors, in this example two servomotors 22, 24, for turning said hooks 18, 18 in such a way that the musical instrument string 12 can be rotated around its longitudinal axis. Said servomotors 22 and 24 are configured to run synchronously, and in this example servomotor 22 is the master and servomotor 24 is the slave. The apparatus 10 also comprises a control device (not shown) for controlling the operation of the servomotors 22 and 24. In this example, the flexing device 16 comprises three rollers 26, 28 and 30 for flexing the musical instrument string 12 clamped between the two points P1 and P2. Said rollers 26, 28 and 30 are mounted on the respective axes 26*a*, 28*a*, 30*a*. In this example said axes 26*a*, 28*a* and 30*a* are parallel to each other in a plane along the musical instrument string 12 and a plane perpendicular to the musical instrument string 12 and spaced apart. In this open condition the flexing apparatus 16 is moved over the musical instrument string 12, so that preferably none of the rollers 26, 28 and 30 touches the musical instrument string 12 (see FIG. 1). Said flexing device 16 is positioned in such a way that the axes 26*a*, 28*a* and 30*a* and thus the rollers 26, 28 and 30 are spaced laterally and longitudinally with reference to a line 32 collinear to the longitudinal direction of the musical instrument string 12 in its original position (as shown in FIG. 1) and the middle of the rollers 26, 28 and 30 is positioned on the level with the musical instrument string 12.

Figure 2:
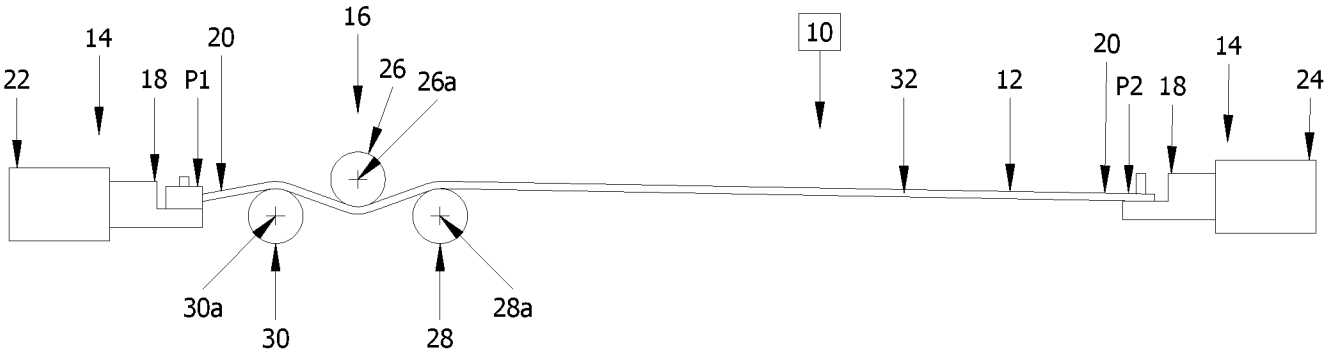

As shown in FIG. 2, the axes 26*a*, 28*a* and 30*a* and thus the rollers 26, 28 and 30 are then moved in the transversal direction of the musical instrument string 12 towards the musical instrument string 12 so that the rollers touch the musical instrument string 12 and press against its surface, and at the same time give the musical instrument string 12 a defined deflection. This can be achieved, because the rollers 26, 28 and 30 are configured to be positioned in such a way that the musical instrument string 12 is stretched alternately to one side and to the other side of the line 32. In other words, as the flexing device 16 is placed in a defined position, the rollers 26, 28 and 30 are closed around the musical instrument string 12 with a defined movement of said 26, 28 and 30. Furthermore, the pull force in the longitudinal direction of the musical instrument string 12 may be readjusted to a defined pull force or during the process running adjusted to a defined pull force by a corresponding device or means (not shown).

The flexing device 16 is now ready for the flexing process.

As can be seen in FIG. 3, the flexing rollers 26, 28 and 30 can be moved forth and back simultaneously in the direction of the line 32.

After that, the flexing device is moved a defined stroke in the longitudinal direction of the musical instrument string and in a defined area of the musical instrument string. The flexing device is moved a defined number of times in a forwarding and reciprocating movement in the longitudinal direction of the musical instrument string, while the closing position of the flexing apparatus is kept constant and the pull force in the longitudinal direction of the musical instrument string is kept constant or readjusted (see FIG. 3).

Furthermore—according to FIG. 4—the musical instrument string 12 can be rotated for example 90° around the line 32 by way of simultaneously rotating the hooks 18, 18 through the servomotors 22 and 24. Said rotation can for example be done after a single pass of moving the rollers 26, 28 and 30 in one direction along the line 32 or after a multi pass. The rollers can be kept in closed position and thus in contact with the musical instrument string or opened, so there is no contact with the musical instrument string during the rotation. The servomotors 22 and 24 rotate the hooks 18, 18, and the musical instrument string 12 for example 90°, and the musical instrument string 12 is then ready for the next step in the flexing process with a defined number of forwarding and reciprocating movements (see FIG. 4). For simultaneous movement of said rollers 26, 28 and 30 they could be arranged on a carriage (not shown).

The flexing process is carried out on the surface of the musical instrument string 12 and can be carried out in the whole or part of the length of the musical instrument string 12. It can be carried out on each of the different wound layers on the musical instrument string 12 or only on the last layer. The flexing process is carried out with the flexing device 16 with forwarding and reciprocating movements in the longitudinal direction of the musical instrument string 12 and from one or more sides.

The flexing process can be carried out in the production of musical instrument strings with one or multiple core threads, (rope) core with an arbitrary number of for example metal or plastic threads/wires or for example multifilament core with an arbitrary number of for example synthetic fibers with wound arbitrary material in one to six layers upon each other.

Already during production of the musical instrument string use of the flexing process will accelerate the stable condition, and thus the musical instrument string will be played in and achieve the desired stable musical quality, response and sound.

During production of a musical instrument string the flexing process can be carried out on an arbitrary layer of wire and/or band wound around a musical instrument string core or wound on top of earlier wound layer(s) or primarily on the last wound layer.

The flexing process is carried out while the musical instrument string is kept clamped in the longitudinal direction preferably with the defined fixed or variable pull force in the longitudinal direction preferably during the whole flexing progress.

In order to be able to make a forwarding and reciprocating flexing movement the musical instrument string is preferably held between two hooks with a defined pull force while the flexing rollers 26, 28, 30 are making forwarding and reciprocating movements controlled by the flexing apparatus/control device.

The flexing process may be carried out with more movements forwarding and reciprocating on the surface of the musical instrument string and in more positions of the musical instrument string rotated around its longitudinal axis, either with a consecutive rotation or rotation of the musical instrument string in steps between one or more flexing movements (see also FIG. 3). The flexing process may be carried out with a variable adjusted flexing force (pressure from the flexing device 16), which is fixed during the whole flexing process or is carried out with a variable adjusted force, which moreover can be varied during the flexing process itself. The flexing process may be carried out arbitrarily chosen one or more times forwarding and reciprocating on the musical instrument string.

The flexing process should be carried out in the whole length of the musical instrument string, in the playable area of the musical instrument string or just in one or more small arbitrary area(s) of the string.

The flexing process may be carried out while the musical instrument string is kept still (no rotation). However, the flexing process can also be carried out while the musical instrument string rotates around its longitudinal axis, or the flexing process can be carried out in turn from more sides of the musical instrument string arbitrarily rotated in the positions for example 0°-90°-180°-270° between the flexing movements, preferably 90° at a time.

The flexing process may be carried out with a flexing apparatus, which is working either manually or automatically.

The flexing process may be carried out with for example rollers like 26, 28 and 30 which roll on the surface of the wire and/or band wound around the musical instrument string. The rollers are displaced from each other in the longitudinal direction and in the transversal direction of the musical instrument string, and are placed on two or more sides of the musical instrument string so that the rollers apply a defined force on the musical instrument string in the transversal direction and a defined bending of the musical instrument string around part of the rollers on the flexing device.

The transversal force from the rollers is defined by the number of the rollers and the position of the rollers. The transversal force on the surface of the musical instrument string can be varied by adjusting the position of the rollers between each other around the musical instrument string, the bending of the musical instrument string around the rollers on the flexing device and the pull force in the longitudinal direction of the musical instrument string.

The longitudinal force on the string, the transversal force on the string, the bending around the rollers, the number of rollers, the number of flexing movements and the flexed area on the string define how effective the process of alignment and seating of the wire(s) and/or band(s) is carried out.

The longitudinal force on the musical instrument string can be between 20 N to 200 N, preferably between 30 N to 100 N.

The flexing process is carried out with two or more flexing rollers that roll on the surface of the musical instrument string and in that way exercise the musical instrument string. The number of the rollers can be chosen from 2 rollers to 8 rollers, preferably 2 rollers to 4 rollers.

The diameter of the rollers and the longitudinal distance between the rollers as well as the overlap of the rollers perpendicularly to the longitudinal direction of the musical instrument string determine the bending of the musical instrument string and in that way how much the musical instrument string is flexed at each flexing movement (pass).

The diameter of the rollers can vary from about 10 mm to about 50 mm, preferably 10 mm to 25 mm. The diameter of the different rollers in the flexing apparatus may be the same or different.

The longitudinal distance A between the rollers center to center, as for example the rollers 28 and 30 shown in FIG. 5*a*, and where A can be between 10 to 100 mm (depending of the diameter of the rollers), preferably between 20 to 60 mm.

The overlap of the rollers perpendicularly to the longitudinal direction of the musical instrument string is defined by the transversal distance B between the rollers center to center, as for example the rollers 26 versus 28 and 30 shown in FIG. 5*a*, and where B can be between 0 mm to 25 mm (depending of the diameter of the rollers), preferably between 5 mm to 15 mm.

The distance C between the opposite rollers on each side of the musical instrument string, as for example the rollers 26 and 28 or 26 and 30 shown in FIG. 5*a*, and where C can be between 0 mm to 80 mm (depending of the diameter of the rollers), preferably between 0.5 mm to 20 mm.

As exemplarily shown in FIG. 5*b*, the rollers 26, 28 and 30 on the flexing apparatus may be designed for example with a smooth surface, with a V-shaped track, a half-round track or a square track in the surface (shown from left to right in FIG. 5*b*). In order to reduce wear on the roller surface, the roller surface can be coated or hardened.

As shown exemplarily in FIG. 6, the number of rollers may be chosen arbitrarily, and the rollers may be arbitrarily placed on two or more sides of the musical instrument string.

The flexing process may be carried out simultaneously from more sides on the musical instrument string with the flexing rollers placed at arbitrarily chosen angles in proportion to one another and still rolling on the string surface or for example in the positions 6×60°, 4×90°, 3×120° or 2×180° between the rollers 26, 28, 30, 31 as exemplarily shown in FIG. 6, preferably 3×120° or 2×180°.

The flexing process may be carried out in extension of the winding processes for each of the wound layers or as a flexing process on the surface of the finished musical instrument string, before any grinding of the surface of the musical instrument string is taking place. Alternatively, the flexing process can be carried out during the grinding of the musical instrument string.

After one or more flexing movements (forwarding and reciprocating movements) the musical instrument string may be rotated a defined number of degrees around the longitudinal direction of the musical instrument string, and the flexing process is repeated with the defined number of flexing movements, while the closing position, the bending of the string and the pull force in the longitudinal direction of the string are kept. This process can be repeated after rotating the musical instrument string a number of degrees around the longitudinal direction of the musical instrument string.

The flexing process is stopped, and the flexing apparatus is opened (see FIG. 1), so that all the rollers are free of the musical instrument string, and the flexing apparatus is moved away from the musical instrument string.

By way of an example, it is explained how the musical instrument string is wound with one or more layers of wire and/or band wound upon previous layers, and then the mentioned flexing process is repeated for each layer. The finished musical instrument string is then grinded.

FIGS. 7*a* to 7*j* show several steps of a method for producing a musical instrument string comprising one or more layers of wire(s) and/or band(s) wound around a core according to a special embodiment of the present invention. For example, the apparatus shown in FIGS. 1 to 4 can be used for carrying out said method. In step 1 (see FIG. 7*a*) a core 34 is set up between two hooks, for example the hooks 18, 18 shown in FIGS. 1 to 4. In step 2 a first layer 36 with for example round wire is helically wound on the core 34, clockwise or counter-clockwise (see FIG. 7*b*). In step 3 (see FIG. 7*c*) the musical instrument string 12 with said first layer 36 is flexed by way of for example the apparatus shown in FIGS. 1 to 4. In step 4 (see FIG. 7*d*) the musical instrument string 12 is turned for example 90° and the flexing process is repeated on the first layer 36. In step 5 (see FIG. 7*e*) a second layer 38 with wire or band is helically wound on the first layer 36. In step 6 (see FIG. 7*f*) the flexing process is carried out on the second layer 38. In step 7 (see FIG. 7*g*) the musical instrument string 12 is turned for example by 90° and the flexing process is repeated on the second layer 38.

Then—in step X—(where X can be 8, 11 or 14) (see FIG. 7*h*) a further layer 40 wire or band can be wound on the musical instrument string 12. In step X+1 (see FIG. 7*i*) the flexing process is carried out on the further layer 40. In step X+2 (see FIG. 7*j*) the musical instrument string 12 is turned for example 90°, and the flexing process is repeated on the further layer 40. The number of layers can be from 2 to 6 layers.

Figure 7A:
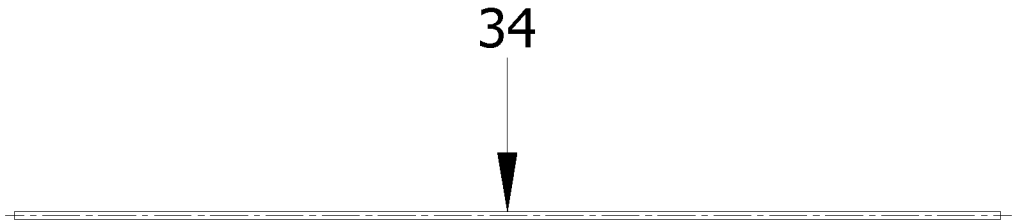
Figure 7B:
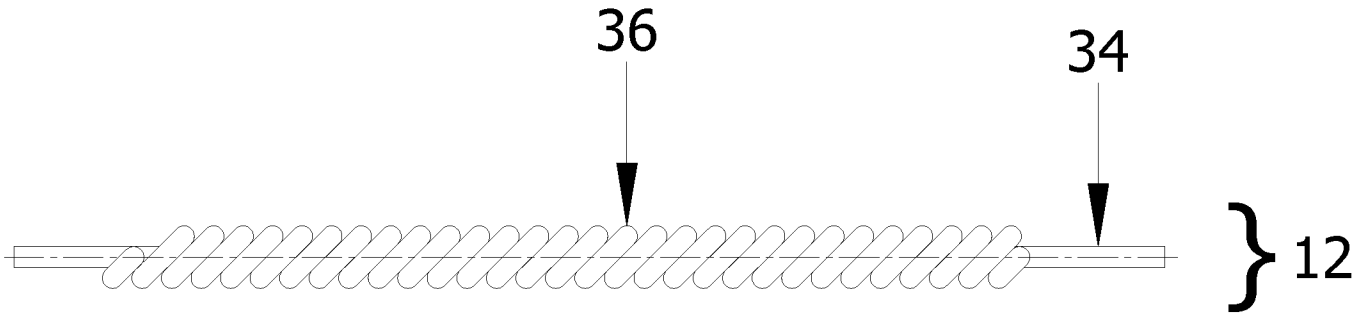
Figure 7C:
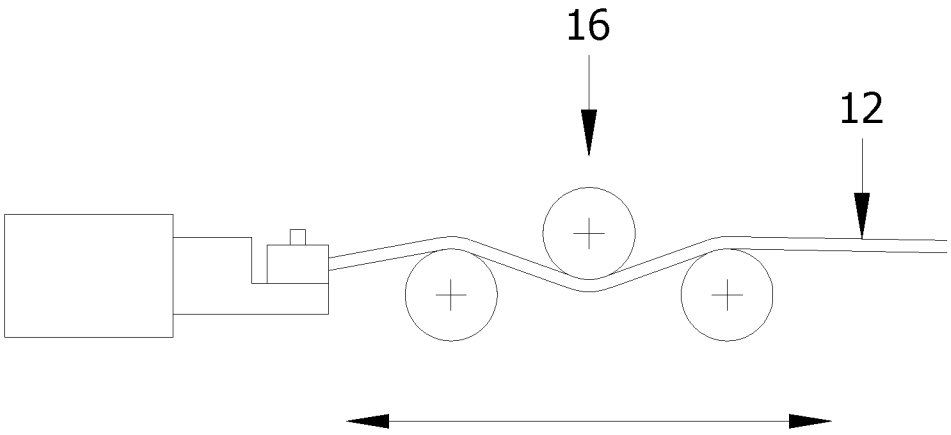
Figure 7D:
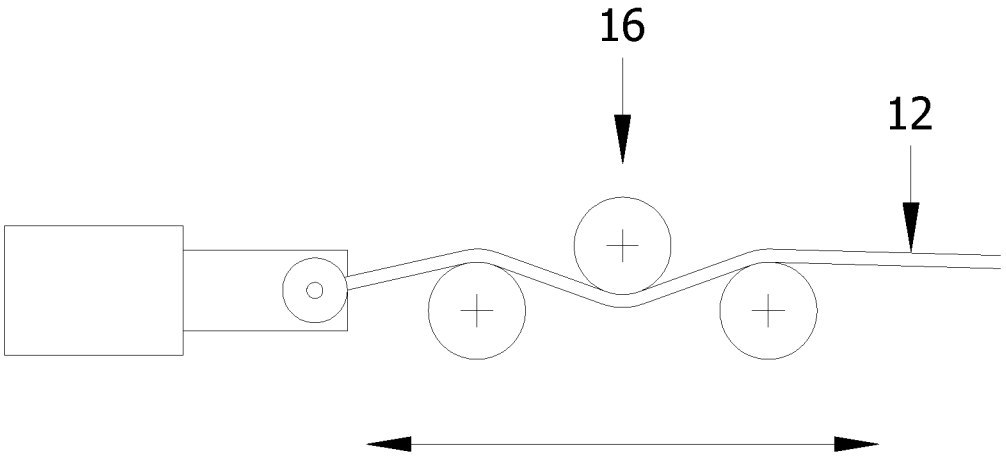
Figure 7E:
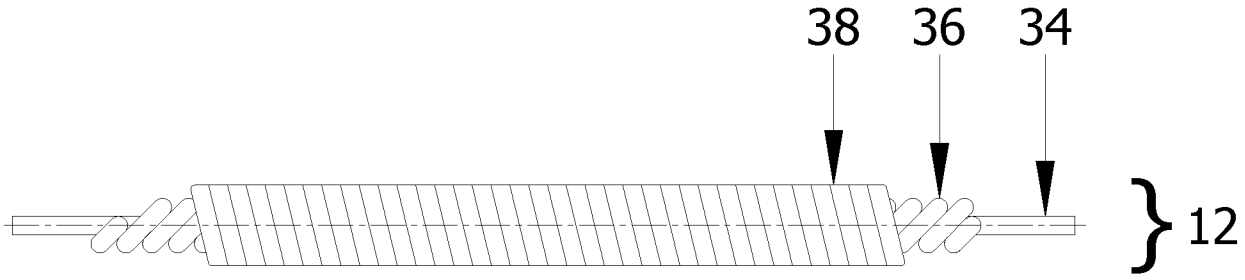
Figure 7F:
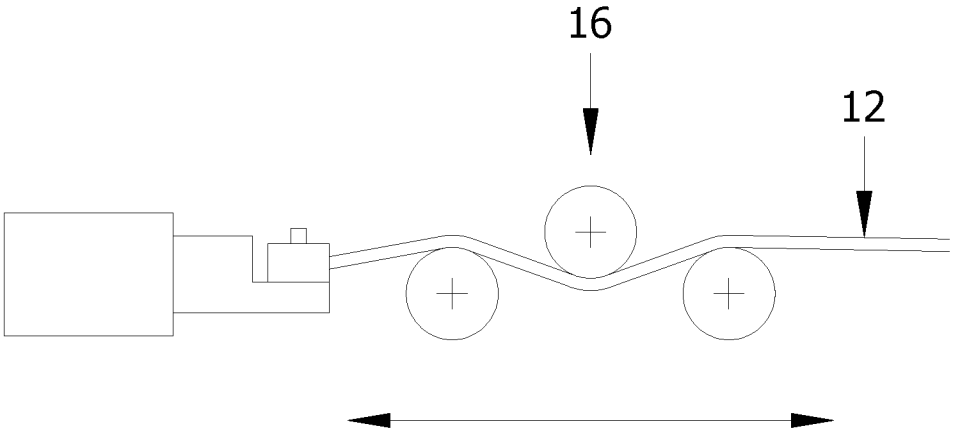
Figure 7G:
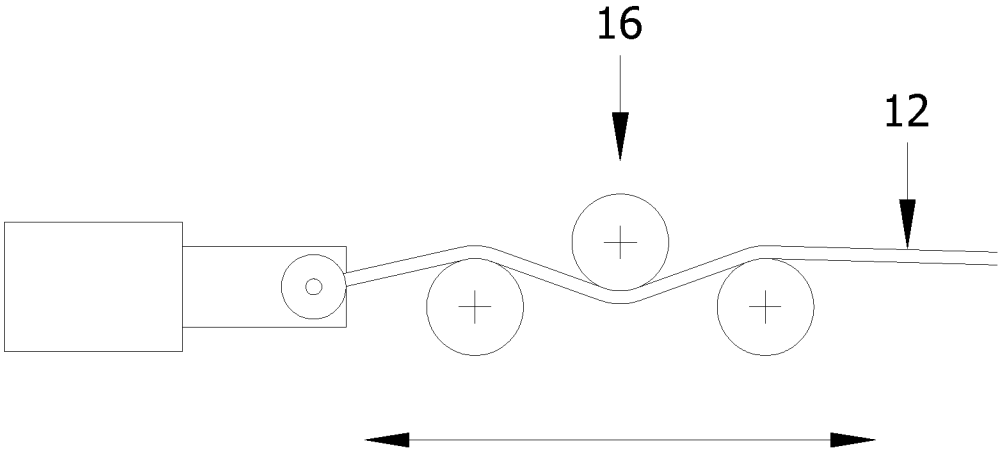
Figure 7H:
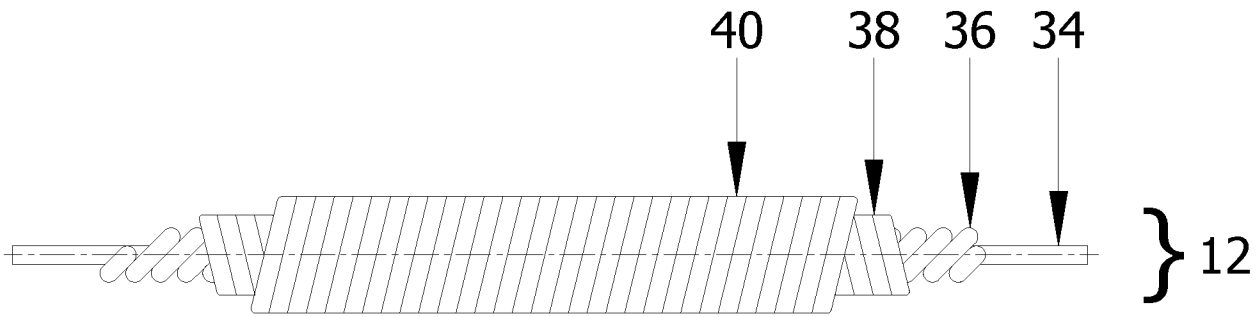
Figure 7I:
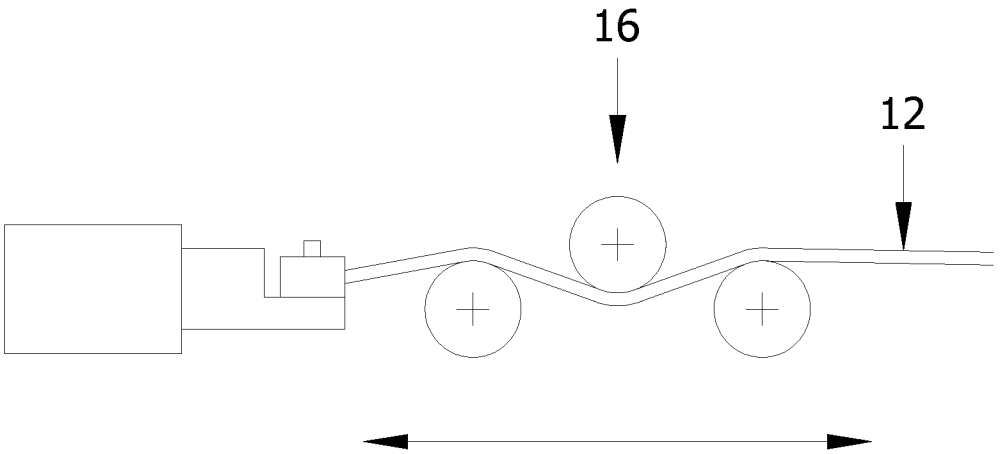
Figure 7J:
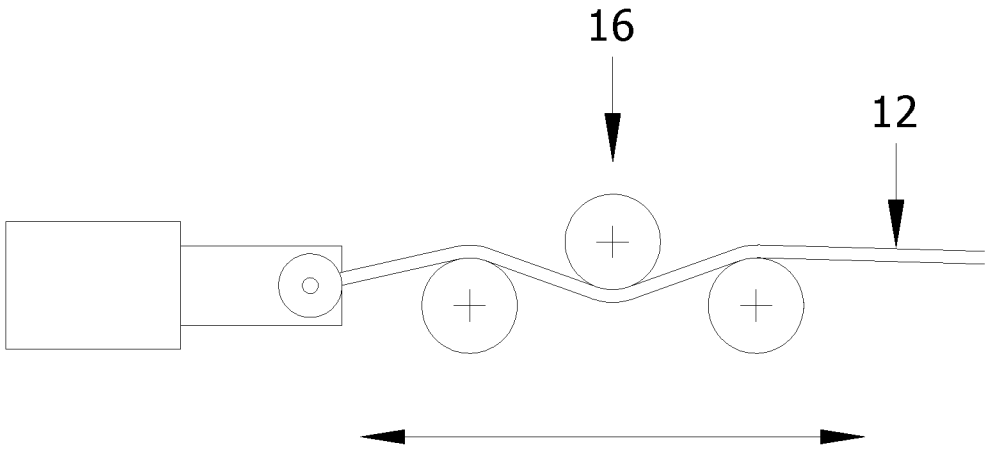
Figure 7K:
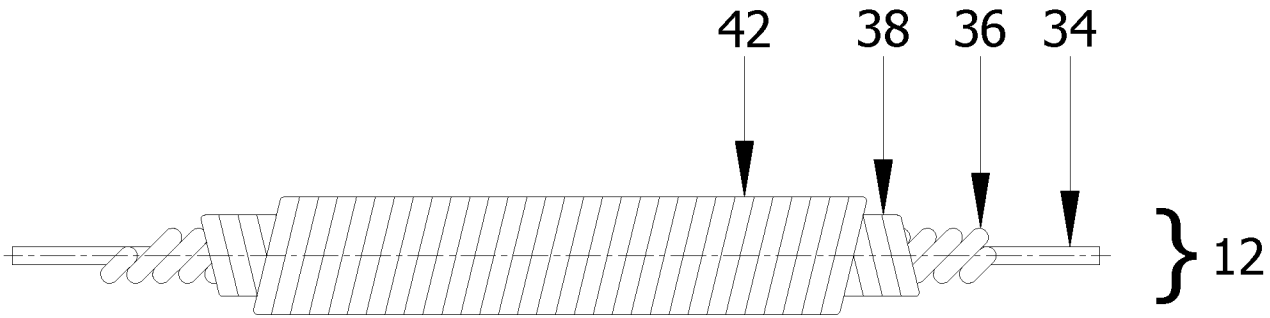

Finally, as shown in FIG. 7*k*, a last layer 42 (which for example could be layer 40) is wound with a metal band, flexed on two sides and then grinded.

FIGS. 8*a* to 8*f* show an alternative to the method shown in FIGS. 7*a* to 7*k*. They show the production of a musical instrument string 12 with two layers of wire(s) and/or band(s) and flexing on only the last wound layer. In step 1 (see FIG. 8*a*) a core 34 is setup between hooks, for example the hooks 18, 18 of the apparatus shown in FIGS. 1 to 4.

In step 2 (see FIG. 8*b*) a first layer 36 with wire or band is wound around the core 34. In step 3 (see FIG. 8*c*) a second and last layer 38 with metal band is wound around the musical instrument string 12.

Then in step 4 (see FIG. 8*d*) the flexing process is carried out on the last layer 42.

In step 5 (see FIG. 8*e*) the musical instrument string 12 is turned for example 90°, and the flexing process is repeated on the last layer 42.

Figure 8A:
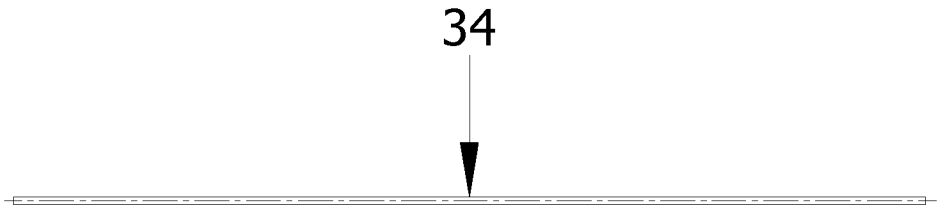
Figure 8B:
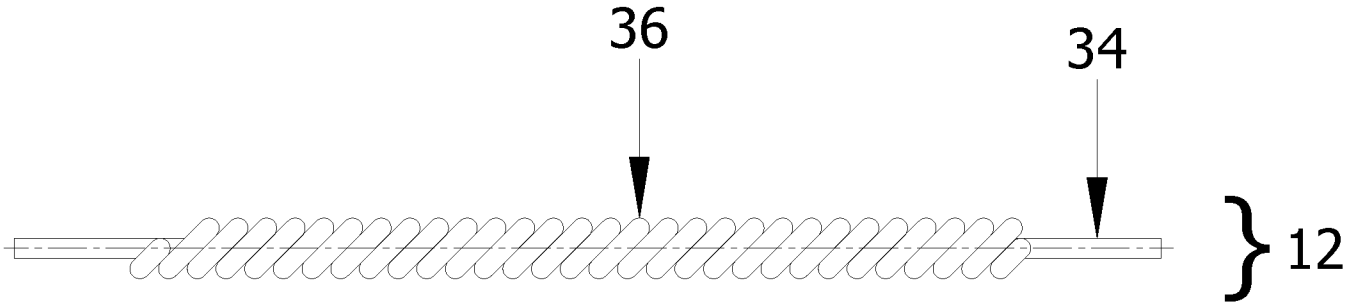
Figure 8C:
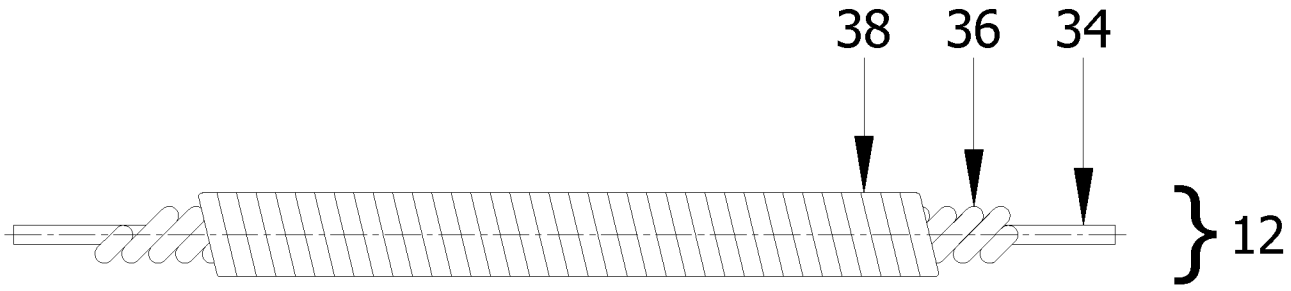
Figure 8D:
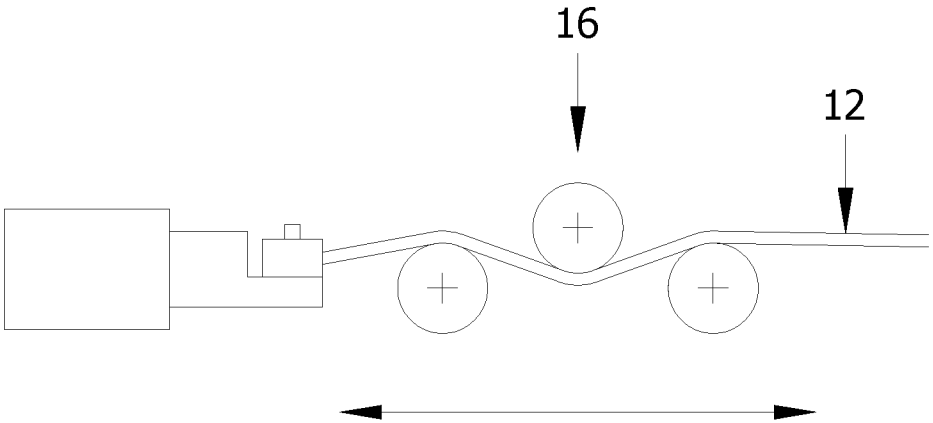
Figure 8E:
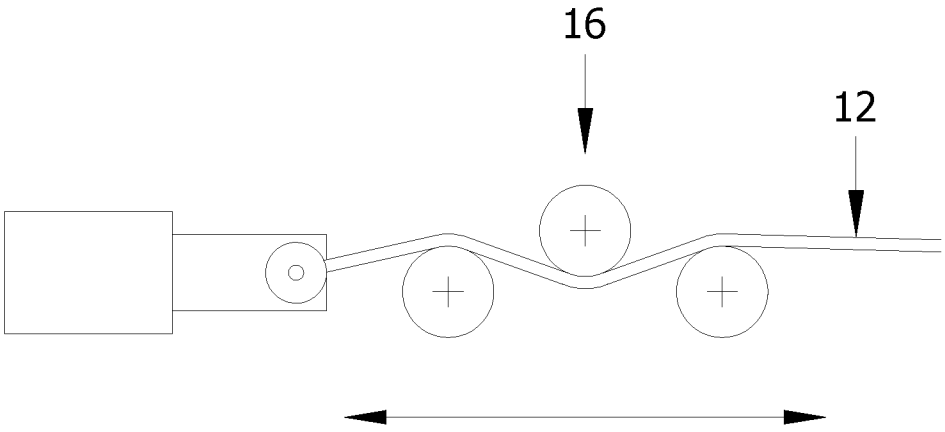
Figure 8F:
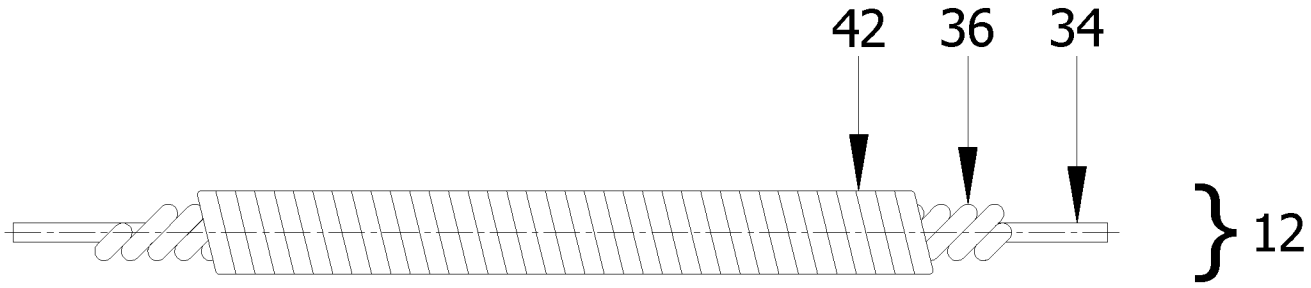

Finally, as shown in FIG. 8*f*, the last layer 42 is grinded.

The flexing process can be carried out in any combination of the two described examples on every wound layer, on selected wound layers or only on the last wound layer.

The features in the above description, in the claims and/or in the accompanying drawings may, both and in any combination of these, be material for realizing the invention in diverse forms.

REFERENCE SIGN

10 apparatus
12 musical instrument string
14 string tension device
16 flexing device
18 hooks
20 string ends
22, 24 servomotors
26, 28, 30, 31 rollers
26*a*, 28*a*, 30*a* axes
32 line
34 core
36 first layer
38 second layer
40 further layer
42 last layer
P1, P2 points

The invention claimed is:

1. Method for producing a musical instrument string comprising one or more layers of wire(s) and/or band(s) wound around a core, in which the method comprises:

carrying out a flexing process on the musical instrument string while the musical instrument string is clamped between two fixed points or with a predefined constant pull force or a variable pull force in the longitudinal direction of the musical instrument string to keep the string taut, during the production as an integrated part of the production or winding process or after winding the last layer on the musical instrument string, but preferably before grinding of the surface of the musical instrument string, for artificial playing in the musical instrument string, wherein the flexing process comprises applying a defined force on the musical instrument string in a direction transversal to the musical instrument string.

2. The method of claim 1, further comprising the flexing process is carried out on the whole length of the musical instrument string or in the playable area of the musical instrument string or just one or more small arbitrary area(s) of the musical instrument string.

3. The method of claim 1, further comprising the flexing process is carried out in a single pass or a multi pass after winding of the last layer on the musical instrument string, wherein a single pass is one movement along the string in one direction and a multi pass is at least one movement forward and/or at least one movement backwards along the string.

4. The method of claim 1, further comprising the flexing process is carried out in a single pass or a multi pass during the production of the musical instrument string, preferably on the last layer or on each layer after winding of one or more layers of wire(s) and/or band(s) around the core.

5. The method of claim 1, further comprising the flexing process is used in a multi pass at the production of the musical instrument string, with short passes starting from an arbitrary place on the musical instrument string and then moving along the musical instrument string in a short area from this place or alternatively broader and broader passes from the starting place on the string in a broader and broader area.

6. The method of claim 1, further comprising the musical instrument string is continuously or discontinuously rotated around its longitudinal axis during flexing.

7. The method of claim 6, further comprising the musical instrument string is rotated around its longitudinal axis after at least one pass of multiple passes or after multiple passes of flexing.

8. The method of claim 1, further comprising a flexing apparatus or device is moved around the musical instrument string.

9. The method of claim 1, further comprising the flexing process comprises bending the musical instrument string to one side and to the other side of a line representing the original position of the musical instrument string when being clamped between said two points, by at least two flexing elements, placed laterally and longitudinally with respect to said line, and moving simultaneously at least said two flexing elements relative to said musical instrument string over at least an area of the length of the musical instrument string, preferably in a reciprocating way.

10. The method of claim 9, further comprising the relative movement of the flexing elements is performed with a manually or automatically driven apparatus or with a hand-held apparatus.

11. The method of claim 9, further comprising the musical instrument string is bent around part of a roller with a predefined force transversal to the musical instrument string.

12. The method of any claim 9, further comprising the at least two flexing elements are rollers, preferably having respective aligned annular grooves therein, preferably perpendicular to the axis of rotation of said rollers, and the rollers are arranged in such a way that they run on the surface of the musical instrument string during production or after spinning of the last layer.

13. The method of claim 12, further comprising the diameter(s) of the rollers is/are in a range of about 10 mm to about 50 mm, preferably 10 mm to 25 mm.

14. The method of claim 13, further comprising at least two diameters of the rollers are identical or different.

15. Apparatus for producing a musical instrument string comprising one or more layers of wire(s) and/or band(s) wound around a core, said apparatus comprising:

a string tensioning device for clamping a musical instrument string between two points with a predefined fixed or variable pull force in the longitudinal direction of the string to keep it taut; and a flexing device, in which said flexing device comprises at least two spaced apart flexing elements configured to be positioned in such a way that the musical instrument string is bent around part of a roller simultaneously to both one side and to the other side of a line representing the original position of the musical instrument string, when being clamped between said two points.

16. The apparatus of claim 15, further comprising at least said two flexing elements are two to eight rollers, mounted for rotation on respective axes (26*a*, 28*a*, 30*a*) perpendicular to said line (32).

17. Method for producing a musical instrument string comprising one or more layers of wire(s) and/or band(s) wound around a core, the method comprising:

placing a core along a path;

rotating the core around its central axis and helically winding one or more layers of wire(s) and/or band(s) on top of the core to create the musical instrument string; and during production, flexing the musical instrument string after each winding of said one or more layers of wire(s) and/or band(s), the flexing comprising applying a defined force on the musical instrument string in a direction transversal to the musical instrument string.

18. The method of claim 17, further comprising the flexing is carried out in a respective single pass or multi pass process.

19. Apparatus for producing a musical instrument string comprising one or more layers of wire(s) and/or band(s) wound around a core, the apparatus comprising:

means for clamping a fixed core of a musical instrument string between two fixed points and for helically winding one or more layer(s) of wire(s) and/or band(s) around the core as the core rotates; and a flexing device (16), in which said flexing device comprises at least two spaced apart flexing elements configured to be positionable so that the musical instrument string is bent to one side and to the other side of a line representing the original position of the musical instrument string when being clamped between said two fixed points.

20. The apparatus of claim 19, further comprising at least said two flexing elements are rollers mounted for rolling on respective axes perpendicular to said line.

21. The apparatus of claim 20, further comprising the axes are parallel to each other.

* * * * *